US005720446A

United States Patent [19]

Blandin

[11] Patent Number: 5,720,446

[45] Date of Patent: Feb. 24, 1998

[54] METHOD AND DEVICE FOR CUTTING PHOTOGRAPHIC PRODUCTS INTO STRIPS

[75] Inventor: Christophe Louis Blandin, Chalon-sur-Saone, France

[73] Assignee: Eastman Kodak Company, Rochester, N.Y.

[21] Appl. No.: 489,530

[22] Filed: Jun. 12, 1995

[30] Foreign Application Priority Data

Jul. 6, 1994 [FR] France ..... 94 08583

[51] Int. Cl.[6] ..... B65H 35/00

[52] U.S. Cl. ..... 242/524.1; 242/526.1

[58] Field of Search ..... 242/521, 524, 242/524.1, 526.1, 530

[56] References Cited

U.S. PATENT DOCUMENTS

| | | | |
|---|---|---|---|
| 1,154,301 | 9/1915 | Fogarty | 242/524.1 |
| 2,328,109 | 8/1943 | Thompson | 242/526.1 |
| 2,364,888 | 12/1944 | Aycock | 242/524.1 |
| 2,585,227 | 2/1952 | Christman | 242/524.1 |
| 2,664,139 | 12/1953 | Speed et al. | 242/524.1 |
| 2,702,581 | 2/1955 | Speed et al. | 242/524.1 |
| 2,849,193 | 8/1958 | Pauls et al. | 242/524.1 |
| 3,286,574 | 11/1966 | Durand | 83/501 |
| 3,730,043 | 5/1973 | Zimmermann | 83/502 |
| 3,823,887 | 7/1974 | Gerstein . | |
| 3,853,279 | 12/1974 | Gerstein . | |
| 4,004,747 | 1/1977 | Schulze | 242/524.1 |
| 4,175,999 | 11/1979 | Schoettle et al. | 242/524.1 |
| 4,428,265 | 1/1984 | Bolton | 83/502 |
| 5,040,737 | 8/1991 | Zeroni et al. | 242/524.1 |

FOREIGN PATENT DOCUMENTS 76965 2/1894 Germany .

*Primary Examiner*—John P. Darling
*Attorney, Agent, or Firm*—Clyde E. Bailey, Sr.

[57] ABSTRACT

A method and device for cutting photographic products into strips is accomplished by perforating a sheet of photographic product along predetermined transverse lines and then guiding the perforated product through a cutting member that cuts the sheet longitudinally so as to produce a plurality of strips. The perforations are formed in the sheet of photographic product with preferably a circular blade that rotates into cutting engagement with the sheet.

4 Claims, 3 Drawing Sheets

$\beta \simeq \pm 10°$

METHOD AND DEVICE FOR CUTTING PHOTOGRAPHIC PRODUCTS INTO STRIPS

The invention concerns a method and device for cutting photographic products into strips.

In the process of manufacturing photographic films, the end product is generally produced from a wide sheet on which a photographic composition is deposited. The sheet is then cut longitudinally so as to produce a photographic product in the desired format. Thus a plurality of strips are produced from the initial sheet.

The narrower strips are then wound onto the core of a reel in order then to be used in auxiliary devices with a view to their final packaging for example.

Typically, after the longitudinal cutting of the sheet and after a desired length of strip has been wound onto the core of the corresponding reels, the device for moving the film is stopped; an operator effects a transverse cut on each of the strips so as to be able to remove the reels. New cores, onto which the free ends of the respective strips are fixed, are then put in position and the process of longitudinal cutting is recommenced.

Traditionally, this transverse cutting is produced by tearing or cutting by means of scissors or a cutter. Apart from the fact of being dangerous for the operator, these techniques have other drawbacks. This is because the position of the transverse cutting varies between strips, so that the length of strip wound on the reels varies from one reel to the other.

This may be disadvantageous from the point of view of the efficiency of the subsequent processing.

In addition, the poor quality of the cutting, resulting either from tearing of the strips or from a cutting which is not at right angles to the axis of the strip, makes it difficult to feed such strips into devices used downstream of the cutting device.

According to other known devices, the transverse cutting is automated. Suitable cutting means are positioned downstream of the means effecting the longitudinal cut. In general the winding reels are aligned on two shafts (an upper shaft and a lower shaft). The reels are disposed alternately on one or other of the shafts. Such an arrangement requires at least two transverse cutting devices; a first one for the top shaft; a second for the lower shaft. This solution, apart from the fact of being expensive, entails a not insignificant increase in size.

Thus one of the objects of the present invention is to produce a device and a method which do not have the drawbacks discussed with reference to the prior art mentioned above.

Other objects of the present invention will emerge in detail in the following description.

These objects are achieved by means of a device for the longitudinal cutting of photographic products into strips, comprising:

a) unwinding means for supplying a sheet of the photographic product;

b) means for cutting the sheet longitudinally in order to produce a plurality of photographic strips, guide means being provided to guide the sheet through the cutting means;

c) winding-on means to wind the strips onto corresponding reels; and d) control means for controlling respectively the unwinding of the sheet and the winding on of the strips;

the device being characterized in that it also comprises means disposed upstream of the longitudinal cutting means so as to produce a transverse pre-cutting line in the sheet.

Advantageously, the means for producing the transverse pre-cutting line comprise a circular blade at the periphery of which teeth are formed, the blade being mounted so as to rotate on an axis parallel to the axis along which the sheet moves, the blade being able to move transversely to the sheet so as to come into engagement with the sheet and to produce a line of perforations in the sheet, at right angles to the edges of the sheet.

Advantageously again, the device according to the invention also comprises means associated with the blade so as to limit the penetration of the blade into the photographic product.

According to the present invention a method is also devised for the longitudinal cutting of photographic products into strips, comprising the following steps:

a) unwinding a sheet of the photographic product and causing it to pass over suitable guide means;

b) cutting the sheet longitudinally so as to produce a plurality of photographic strips;

c) winding the strips onto corresponding reels; and d) cutting each of the strips transversely when a sufficient length of strip has been wound onto the reels;

the method being characterized in that it also comprises the following step:

i) producing a transverse pre-cutting line in the sheet prior to the longitudinal cutting.

According to a first alternative, step d) comprises the following steps:

i) stopping the unwinding of the sheet and the winding on of the strip when the transverse pre-cutting line is substantially at the point of contact of the strips and their respective reel; and ii) cutting the strips at their respective transverse pre-cutting line.

In the following description, reference will be made to the drawing in which.

Figure 1:
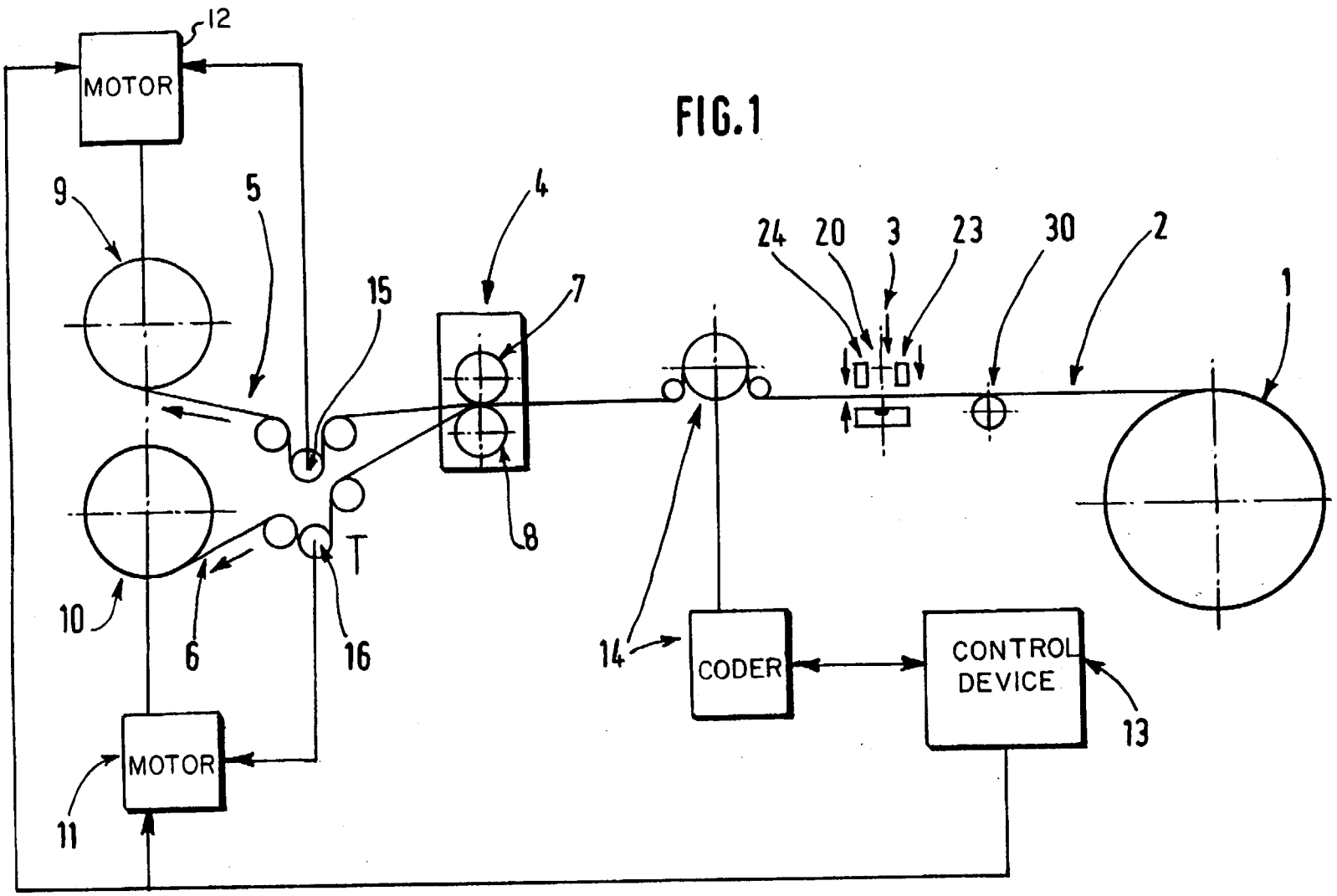
FIG. 1 shows diagrammatically an embodiment of the cutting device according to the invention.

As shown in FIG. 1, the device according to the present invention comprises a reeling device 1 on which a sheet of photographic material 2 is wound. The sheet coming from the reeling means 1 passes in front of a pre-cutting device 3 at which the movement of the sheet is stopped and a transverse pre-cutting line is effected over substantially the entire width of the sheet. Advantageously, this pre-cutting line consists of a line of perforations formed in the sheet by means of a device which will be the subject of a more detailed description later.

The sheet then passes in front of a longitudinal cutting device 4, at the end of which a plurality of photographic strips 5, 6 is produced. Typically, the cutting unit 4 is in the form of a cutting shaft 7 on which a plurality of circular blades are mounted, provided with a central hole and designed to be brought into contact with corresponding counter-blades mounted also on a shaft 8, parallel to the first. Such cutting devices are well known in the art and consequently do not require any additional description. By way of example, such cutting devices are amply described in the patent FR-A-2 439 736 and in the patents U.S. Pat. No. 3,286,574, U.S. Pat. No. 3,730,043 and U.S. Pat. No. 4,428,265.

The strips 5, 6 produced by the cutting device 4 are then guided towards the winding-on devices 9, 10. Typically, these winding-on devices are in the form of reels, the core of which is rotated by motors 11, 12 controlled by a control device 13, such as a microprocessor device. The latter receives control signals, for example from a measuring coder 14, which continuously measures the length of strip passing in front of the coder. The motors 11, 12 also receive control signals given by devices 15, 16, designed to measure the tension in the strips when winding on. None of these monitoring and control devices constitutes the object of the present invention, and they do not require any more detailed explanations.

The reels 9, 10 on which the strips are wound are, according to the embodiment depicted, aligned on two shafts (an upper shaft and a lower shaft). The spools are disposed alternately on one or other of the shafts.

Figure 2A:
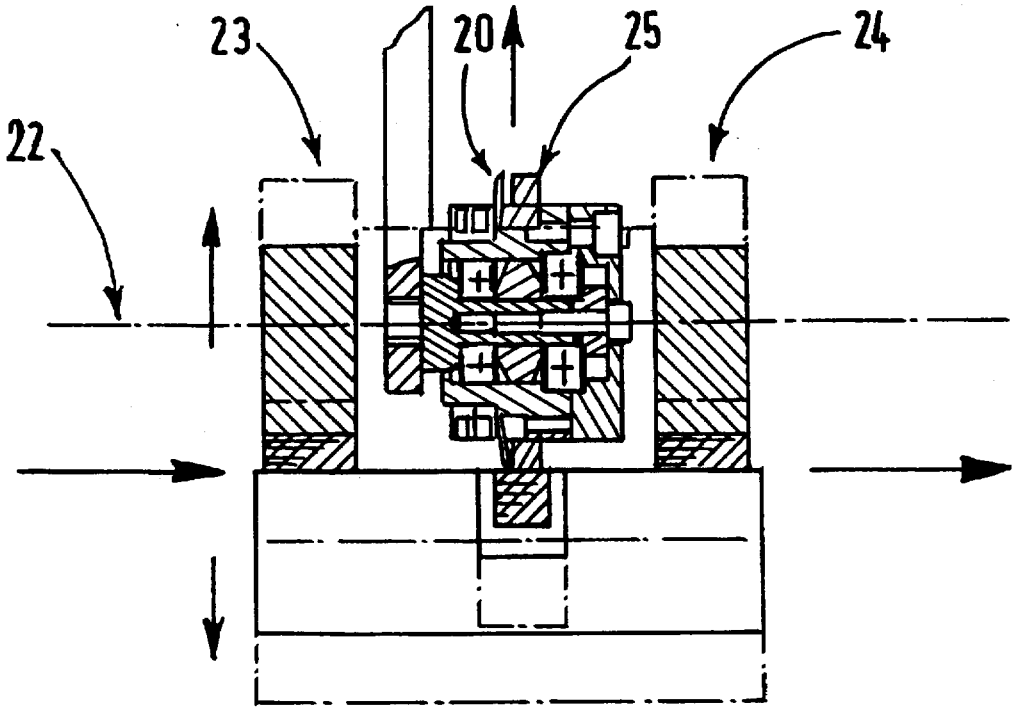
FIGS. 2A–2B depict diagrammatically an embodiment of the scoring means used in the device according to the present invention.
Figure 2B:
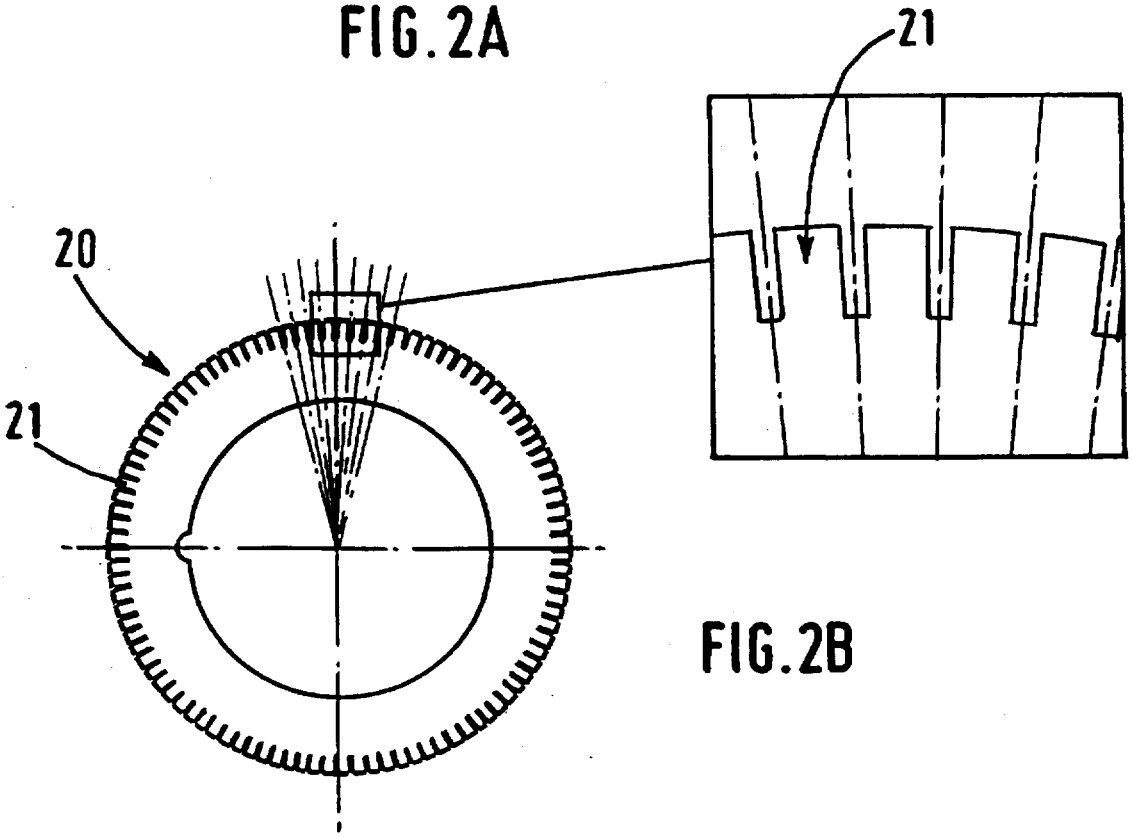

FIGS. 2A–2B, to which reference is now made, show diagrammatically an embodiment of the pre-cutting device 3 used according to the present invention. Advantageously this mainly comprises a circular blade 20 provided at its periphery with teeth 21. Advantageously it is sharpened asymmetrically and is mounted so that the worst side of the cut is located on the inside of the winding-on reels. The circular blade is mounted so as to rotate on an axis 22, parallel to the axis of movement of the sheet, and can also move in translation across the sheet 2 so as to produce a pre-cutting line over substantially the entire width of the sheet. In the embodiment depicted, a line of perforations is produced. According to a first example, two pressure devices 23, 24 are used, disposed on each side of the circular blade in order to hold the sheet in position during the pre-cutting. Advantageously again, another wheel 25 is used, mounted alongside the circular blade 20 on the same axis 22 but with a diameter less than that of the blade in order to control the depth of penetration of the blade into the sheet.

Figure 3:
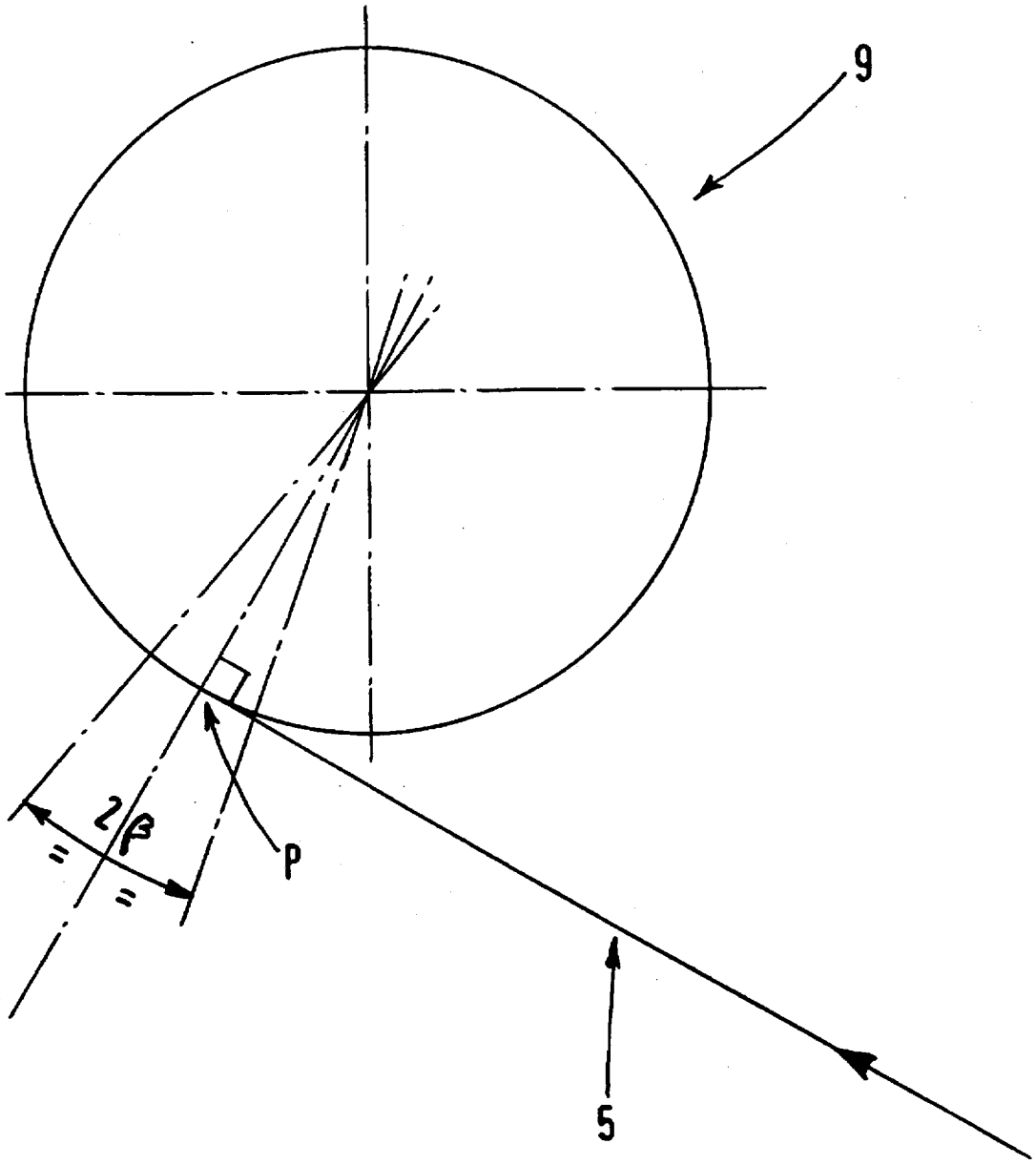
FIG. 3 is a diagram illustrating the position at which the operator separates the strips from the sheet in the device according to the present invention.

During operation, the movement of the sheet is stopped so that the pre-cutting device is situated on the sheet at a position corresponding to the length of strip which it is desired to wind onto the reels 9, 10; the pressure devices are lowered onto the sheet; the circular blade is driven so as to produce, over substantially the entire width of the sheet, transversely to its axis of movement (or to its edges), a pre-cutting line; the movement of the sheet and the winding on of the strips 5, 6 is then restarted until the transverse score line is substantially at the point of contact of the strips and their respective reel. In reality, an angle of approximately 10° around the point of contact is entirely acceptable. This arrangement is illustrated diagrammatically in FIG. 3. Such a solution then makes it easier for the operator to tear the strips along this pre-cutting line. Tearing of the strip is effected very easily simply by the operator pulling on the strips at an area adjacent to the pre-cutting line (P). Alternatively, the transverse cutting is effected by alternate folding around the pre-cutting line. At this time, the reels are replaced with empty cores onto which the free ends of the strips 5, 6 are fed for the purpose of a new winding-on cycle.

The advantages of the device and method according to the present invention may be summarised thus: they make it possible to dispense with the use of cutting tools which may be dangerous under the conditions of use of photosensitive products; the cutting is of good quality, making the re-feeding of the strips onto auxiliary devices easier; the reels are all of substantially identical length.

The device and method according to the present invention have just been described with reference to preferred embodiments. Obviously variations can be made to these embodiments without departing from the spirit of the invention. For example, the transverse pre-cutting can be effected without stopping the movement of the sheet by means of a rotary tool, the axis of rotation of which would be substantially parallel to the width of the sheet and the tangential speed of which would be synchronised with the speed of the sheet. According to another alternative, a power laser or a water jet can be used to produce a pre-cutting line in the form of a continuous or alternating removal of material over substantially the entire width of the sheet in order to produce a line of least resistance in the sheet. Other techniques still may be used.

I claim:

1. Device for the longitudinal cutting of photographic products into strips, comprising:

a) unwinding means for supplying a sheet of said photographic product;

b) means for cutting said sheet longitudinally in order to produce a plurality of photographic strips, guide means being provided to guide said sheet through said cutting means;

c) winding-on means to wind said strips onto corresponding reels; and d) control means for controlling respectively the unwinding of the sheet and the winding on of the strips;

said device being characterized in that it also comprises means disposed upstream of the longitudinal cutting means so as to produce a transverse pre-cutting line (P) in the sheet, said means comprising a circular blade at the periphery of which teeth are formed, the blade being mounted so as to rotate on an axis parallel to the axis along which the sheet moves, said blade being able to move transversely to said sheet so as to come into engagement with the sheet and to produce a line of perforations (P) in said sheet, at right angles to the edges of the sheet.

2. Device according to claim 1, wherein means operatively cooperating with the blade is provided to limit the penetration of the blade into said photographic product.

3. Method for the longitudinal cutting of photographic products into strips, comprising the following steps:

a) guidably unwinding a sheet of said photographic product from a supply roll for movement toward a plurality of corresponding reels;

b) introducing said sheet longitudinally to a cutting member;

c) producing a transverse pre-cutting line (P) of said sheet;

d) cutting said sheet longitudinally so as to produce a plurality of photographic strips;

e) winding said strips onto said plurality of corresponding reels; and f) cutting each of the strips transversely when a predetermined length of strip has been wound onto said reels; said cutting step comprising the steps of:

i) stopping the movement of the photographic product when the transverse pre-cutting line (P) is substantially at the point of contact of the strips and their respective reels; and ii) cutting the strips at their respective transverse pre-cutting lines.

4. Method according to claim 3 characterized in that the transverse cutting of the strips is effected by an operator pulling on the strip or by the alternate folding of the strip around the pre-cutting line.

* * * * *